US009715982B2

(12) United States Patent
Lv et al.

(10) Patent No.: US 9,715,982 B2
(45) Date of Patent: Jul. 25, 2017

(54) ALARM CIRCUIT FOR ELECTRONIC DEVICE

(71) Applicants: HONG FU JIN PRECISION INDUSTRY (WuHan) CO., LTD., Wuhan (CN); HON HAI PRECISION INDUSTRY CO., LTD., New Taipei (TW)

(72) Inventors: Jia-Peng Lv, Wuhan (CN); Chun-Sheng Chen, New Taipei (TW)

(73) Assignees: HONG FU JIN PRECISION INDUSTRY (WuHan) CO., LTD., Wuhan (CN); HON HAI PRECISION INDUSTRY CO., LTD., New Taipei (TW)

( * ) Notice: Subject to any disclaimer, the term of this patent is extended or adjusted under 35 U.S.C. 154(b) by 154 days.

(21) Appl. No.: 14/716,221

(22) Filed: May 19, 2015

(65) Prior Publication Data

US 2016/0314668 A1 Oct. 27, 2016

(30) Foreign Application Priority Data

Apr. 22, 2015 (CN) ..... 2015 1 0192771

(51) Int. Cl.
*G08B 17/10* (2006.01)
*H01H 47/00* (2006.01)
*G08B 17/103* (2006.01)

(52) U.S. Cl.
CPC ..... *H01H 47/00* (2013.01); *G08B 17/103* (2013.01)

(58) Field of Classification Search
None
See application file for complete search history.

(56) References Cited

U.S. PATENT DOCUMENTS 3,603,949 A * 9/1971 Walthard ..... G08B 29/145 340/509
3,840,868 A * 10/1974 Campman ..... G08B 13/1895 250/221
3,846,773 A * 11/1974 Lintelmann ..... G08B 17/103 340/515
4,023,152 A * 5/1977 Okuda ..... G08B 17/11 250/381
4,025,915 A * 5/1977 Enemark ..... G08B 17/107 250/574
4,063,227 A * 12/1977 Petersen ..... G08B 17/107 250/552
4,065,759 A * 12/1977 Handing ..... G08B 17/103 250/574

(Continued)

*Primary Examiner* — Hai Phan
*Assistant Examiner* — Son M Tang
(74) *Attorney, Agent, or Firm* — Steven Reiss

(57) ABSTRACT

An alarm circuit for electronic device includes a detection unit, a signal conversion circuit, and an alarm control circuit. The detection unit is configured to detect a working status of an electronic device, and output a control signal of a first voltage level when the detection circuit determines the presence of smoke in the electronic device. The signal conversion circuit is configured to receive the control signal of the first voltage level, and convert the control signal of the first voltage level to an alarm signal of a first voltage level. The alarm control circuit is configured to receive the alarm signal of the first voltage level and transmit an alarm.

13 Claims, 2 Drawing Sheets

(56) References Cited

U.S. PATENT DOCUMENTS

| | | | | | |
|---|---|---|---|---|---|
| 4,155,653 | A * | 5/1979 | San Miguel | G01N 21/534 | 250/564 |
| RE30,620 | E * | 5/1981 | Sweany | G08B 17/11 | 250/381 |
| 4,328,424 | A * | 5/1982 | O'Connor | G08B 17/113 | 250/384 |
| 4,404,548 | A * | 9/1983 | Mueller | G08B 26/005 | 340/10.1 |
| 4,538,137 | A * | 8/1985 | Kimura | G08B 17/06 | 307/653 |
| 4,725,821 | A * | 2/1988 | Kimura | G08B 25/04 | 340/510 |
| 5,420,440 | A * | 5/1995 | Ketler | G01N 21/534 | 250/573 |
| 5,479,115 | A * | 12/1995 | Ueda | H03K 19/00376 | 326/63 |
| 5,670,948 | A * | 9/1997 | Mochizuki | G08B 17/107 | 250/573 |
| 6,094,143 | A * | 7/2000 | Nakajima | G08B 17/103 | 250/574 |
| 6,762,570 | B1 * | 7/2004 | Fosler | H05B 37/0254 | 315/294 |
| 8,629,779 | B2 * | 1/2014 | Aebersold | G08B 17/107 | 340/628 |
| 2011/0031419 | A1 * | 2/2011 | Fukui | G08B 17/107 | 250/574 |
| 2016/0209452 | A1 * | 7/2016 | Dome | G01R 31/006 | |

* cited by examiner

ALARM CIRCUIT FOR ELECTRONIC DEVICE

CROSS-REFERENCE TO RELATED APPLICATIONS

This application claims priority to Chinese Patent Application No. 201510192771.X filed on Apr. 22, 2015, the contents of which are incorporated by reference herein in its entirety.

FIELD

The subject matter herein generally relates to an alarm circuit for electronic devices.

BACKGROUND

In electronics and particularly in computer electronics, a number of heat dissipation components are fixed on printed circuit boards, such as the motherboards of computers. When the motherboards malfunction after a long period of working, the heat dissipation components may overheat and start a fire.

BRIEF DESCRIPTION OF THE DRAWINGS

Implementations of the present technology will now be described, by way of example only, with reference to the attached figures.

DETAILED DESCRIPTION

Figure 1:
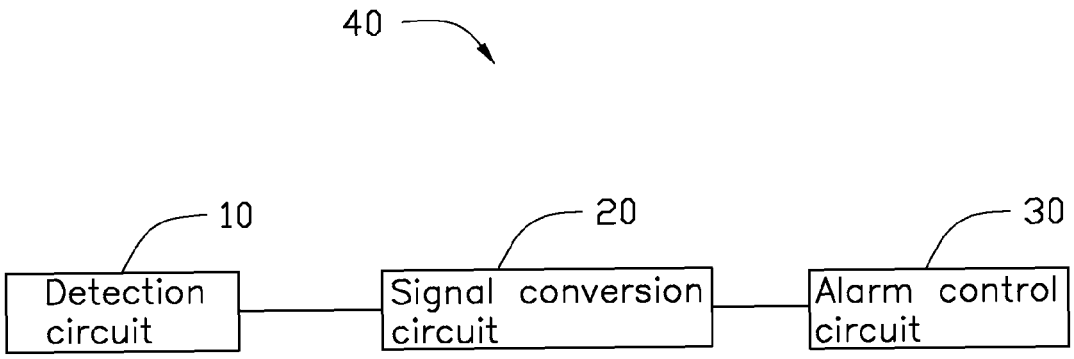
FIG. 1 is a block diagram of an embodiment of an alarm circuit for electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series and the like. "Unit" means a collection of electronic hardware alone or in combination with software configured for a particular task or function, although units may overlap or share components.

FIG. 1 illustrates an alarm circuit for electronic device in accordance with one embodiment. The alarm circuit includes a detection circuit 10, a signal conversion circuit 20, and an alarm control circuit 30. The detection circuit 10 is configured to detect a working status of an electronic device 40, and output a control signal of a first voltage level when the detection circuit 10 determines the presence of smoke in the electronic device 40. The signal conversion circuit 20 is configured to receive the control signal of first voltage level, and convert the control signal of first voltage level to an alarm signal of a first voltage level. The alarm control circuit 30 is configured to receive the alarm signal of first voltage level and transmit an alarm.

Figure 2:
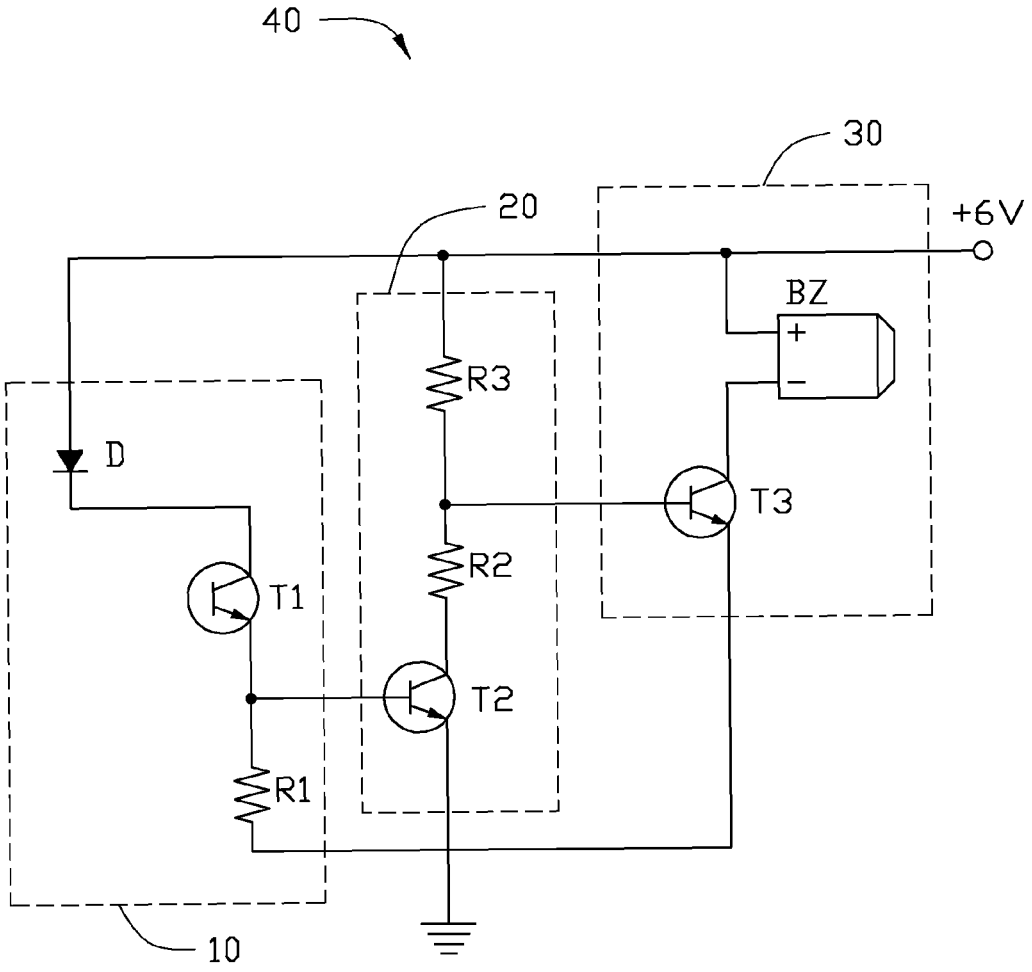
FIG. 2 is a circuit diagram of the alarm circuit for electronic device of FIG. 1.

FIG. 2 illustrates that the detection circuit 10 includes a diode D, a first switch T1, and a first resistor R1. The diode D includes an anode and a cathode. The first switch T1 includes a first terminal and a second terminal. The anode of the diode D is configured to receive a direct current (DC) voltage. The cathode of the diode D is electrically coupled to the first terminal of the first switch T1. The second terminal of the first switch T1 is grounded via the first resistor R1. A connection point between the second terminal of the first switch T1 and the first resistor R1 is configured to output the control signal. In at least one embodiment, the diode D is an infrared light emitting diode (LED), the first switch T1 is an npn type phototransistor, the first terminal and the second terminal of the first switch T1 are collector and emitter respectively, and the DC voltage is a +6 volts standby voltage.

The signal conversion circuit 20 includes a second switch T2, a second resistor R2, and a third resistor R3. The second switch T2 includes a first terminal, a second terminal, and a third terminal. The first terminal of the second switch T2 is electrically coupled to the connection point between the second terminal of the first switch T1 and the first resistor R1 and is configured to receive the control signal. The second terminal of the second switch T2 is grounded. The third terminal of the second switch T2 is configured to receive the DC voltage via the second resistor R2 and the third resistor R3 connected in series. A connection point between the second resistor R2 and the third resistor R3 is configured to output the alarm signal. In at least one embodiment, the second switch T2 is an npn type transistor, and the first terminal, the second terminal, and the third terminal of the second switch T2 are base, emitter, and collector respectively.

The alarm control circuit 30 includes a third switch T3 and an alarm unit BZ. The third switch T3 includes a first terminal, a second terminal, and a third terminal. The alarm unit BZ includes an anode and a cathode. The first terminal of the third switch T3 is electrically coupled to the connection point between the second resistor R2 and the third resistor R3 and is configured to receive the alarm signal. The second terminal of the third switch T3 is grounded. The third terminal of the third switch T3 is electrically coupled to the cathode of the alarm unit BZ. The anode of the alarm unit BZ is configured to receive the DC voltage. In at least one embodiment, the third switch T3 is an npn type transistor, the alarm unit BZ is a buzzer, and the first terminal and the second terminal of the third switch T3 are base, emitter, and collector respectively.

In use, the anode of the diode D receives the DC voltage, the diode D is power on and emits infrared light. When the detection circuit 10 does not determine the presence of smoke in the electronic device 40, the infrared light from the diode D is clearly received by the first switch T1. The first switch T1 turns on. A resistance of the first switch T1 is decreased. A total resistance of the diode D and the first switch T1 is decreased. A current flowing through the diode D and the first switch T1 is increased. Strength of the infrared light from the diode D is further increased. The first switch T1 turns on to further decrease the resistance of the first switch T1. The current flowing through the diode D and the first switch T1 is increased to a maximum value. The connection point between the second terminal of the first switch T1 and the first resistor R1 outputs the control signal of a high voltage level to the first terminal of the second switch T2. The second switch T2 turns on. The connection point between the second resistor R2 and the third resistor R3 outputs the alarm signal of a low voltage level to the first terminal of the third switch T3. The third switch T3 turns off. The anode of the alarm unit BZ cannot receive the DC voltage. The alarm unit BZ does not sound.

When the detection circuit 10 determines the presence of smoke in the electronic device 40, the infrared light from the diode D is not clearly received by the first switch T1. The first switch T1 cannot turn on. The resistance of the first switch T1 is increased. The total resistance of the diode D and the first switch T1 is increased. The current flowing through the diode D and the first switch T1 is decreased. The strength of the infrared light from the diode D is further decreased. The first switch T1 turns off to further increase the resistance of the first switch T1. The current flowing through the diode D and the first switch T1 is decreased to a minimum value. The connection point between the second terminal of the first switch T1 and the first resistor R1 outputs the control signal of a low voltage level to the first terminal of the second switch T2. The second switch T2 turns off. The connection point between the second resistor R2 and the third resistor R3 outputs the alarm signal of a high voltage level to the first terminal of the third switch T3. The third switch T3 turns on. The anode of the alarm unit BZ receives the DC voltage. The alarm unit BZ sounds.

The embodiments shown and described above are only examples. Many details are often found in the art such as the other features of an alarm circuit for electronic device. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An alarm circuit for electronic device comprising:

a detection circuit configured to detect a working status of an electronic device and output a control signal of a first voltage level when the detection circuit determines the presence of smoke in the electronic device;

a signal conversion circuit configured to receive the control signal of the first voltage level and convert the control signal of the first voltage level to an alarm signal of a first voltage level;

an alarm control circuit configured to receive the alarm signal of the first voltage level and transmit an alarm, wherein the detection circuit comprises a diode, a first switch, and a first resistor; the diode comprises an anode and a cathode; the first switch comprises a first terminal and a second terminal, the anode of the diode is configured to receive a direct current (DC) voltage; the cathode of the diode is electrically coupled to the first terminal of the first switch, the second terminal of the first switch is grounded via the first resistor; and a connection point between the second terminal of the first switch and the first resistor is configured to output the control signal; and wherein the signal conversion circuit comprises a second switch, a second resistor, and a third resistor; the second switch comprises a first terminal, a second terminal, and a third terminal; the first terminal of the second switch is electrically coupled to the connection point between the second terminal of the first switch and the first resistor and is configured to receive the control signal; the second terminal of the second switch is grounded; the third terminal of the second switch is configured to receive the DC voltage via the second resistor and the third resistor connected in series; and a connection point between the second resistor and the third resistor is configured to output the alarm signal.

2. The alarm circuit for electronic device of claim 1, wherein the control signal of the first voltage level is a low voltage level; and the alarm signal of the first voltage level is a high voltage level.

3. The alarm circuit for electronic device of claim 1, wherein the diode is an infrared light emitting diode (LED); the first switch is an npn type phototransistor; the first terminal and the second terminal of the first switch are collector and emitter respectively; and the DC voltage is a +6 volts standby voltage.

4. The alarm circuit for electronic device of claim 1, wherein the second switch is an npn type transistor; and the first terminal, the second terminal, and the third terminal of the second switch are base, emitter, and collector respectively.

5. The alarm circuit for electronic device of claim 1, wherein the alarm control circuit comprises a third switch and an alarm unit; the third switch comprises a first terminal, a second terminal, and a third terminal; the alarm unit comprises an anode and a cathode; the first terminal of the third switch is electrically coupled to the connection point between the second resistor and the third resistor and is configured to receive the alarm signal; the second terminal of the third switch is grounded; the third terminal of the third switch is electrically coupled to the cathode of the alarm unit; and the anode of the alarm unit is configured to receive the DC voltage.

6. The alarm circuit for electronic device of claim 5, wherein the third switch is an npn type transistor, the alarm unit is a buzzer; and the first terminal and the second terminal of the third switch are base, emitter, and collector respectively.

7. An alarm circuit for electronic device comprising:

a detection circuit comprising a diode and a first switch and configured to detect a working status of an electronic device, and output a control signal of a first voltage level when the detection circuit determines the presence of smoke in the electronic device;

a signal conversion circuit comprising a second switch and configured to receive the control signal of the first voltage level, and convert the control signal of the first voltage level to an alarm signal of a first voltage level; and an alarm control circuit comprising a third switch and an alarm unit and configured to receive the alarm signal of the first voltage level and transmit an alarm, wherein when the detection circuit determines the presence of smoke in the electronic device, the diode emits light which is partially received by the first switch, the first switch cannot turns on absolutely, a resistance of the first switch is increased, a total resistance of the diode and the first switch is increased, a current flowing through the diode and the first switch is decreased, a strength of the infrared light from the diode is further decreased, the first switch turns off absolutely to further increase the resistance of the first switch, the current flowing through the diode and the first switch is decreased to a minimum value, the first switch outputs the control signal of a low voltage level to the second switch, the second switch turns off and outputs the alarm signal of a high voltage level to the third switch, the third switch turns on, and the alarm unit transmit the alarm.

8. The alarm circuit for electronic device of claim 7, wherein the detection circuit further comprises a first resistor; the diode comprises an anode and a cathode; the first switch comprises a first terminal and a second terminal; the anode of the diode is configured to receive a direct current (DC) voltage; the cathode of the diode is electrically coupled to the first terminal of the first switch; the second terminal of the first switch is grounded via the first resistor; and a connection point between the second terminal of the first switch and the first resistor is configured to output the control signal.

9. The alarm circuit for electronic device of claim 8, wherein the diode is an infrared light emitting diode (LED); the first switch is an npn type phototransistor; the first terminal and the second terminal of the first switch are collector and emitter respectively; and the DC voltage is a +6 volts standby voltage.

10. The alarm circuit for electronic device of claim 8, wherein the signal conversion circuit further comprises a second resistor and a third resistor; the second switch comprises a first terminal, a second terminal, and a third terminal; the first terminal of the second switch is electrically coupled to the connection point between the second terminal of the first switch and the first resistor and is configured to receive the control signal; the second terminal of the second switch is grounded; the third terminal of the second switch is configured to receive the DC voltage via the second resistor and the third resistor connected in series; and a connection point between the second resistor and the third resistor is configured to output the alarm signal.

11. The alarm circuit for electronic device of claim 10, wherein the second switch is an npn type transistor; and the first terminal, the second terminal, and the third terminal of the second switch are base, emitter, and collector respectively.

12. The alarm circuit for electronic device of claim 10, wherein the third switch comprises a first terminal, a second terminal, and a third terminal; the alarm unit comprises an anode and a cathode; the first terminal of the third switch is electrically coupled to the connection point between the second resistor and the third resistor and is configured to receive the alarm signal; the second terminal of the third switch is grounded; the third terminal of the third switch is electrically coupled to the cathode of the alarm unit; and the anode of the alarm unit is configured to receive the DC voltage.

13. The alarm circuit for electronic device of claim 12, wherein the third switch is an npn type transistor, the alarm unit is a buzzer; and the first terminal and the second terminal of the third switch are base, emitter, and collector respectively.

* * * * *